United States Patent [19]

Foley et al.

[11] Patent Number: 4,554,979

[45] Date of Patent: Nov. 26, 1985

[54] CONDUIT ARRANGEMENT FOR TILT CYLINDER OF A BULLDOZER

[75] Inventors: Robert W. Foley, Addison; Robert C. Storck, Wheaton, both of Ill.; Donald J. Mickus, deceased, late of Chicago, Ill.; by Debbie Pastors, executrix, Oak Park, Ill.

[73] Assignee: Dresser Industries, Inc., Dallas, Tex.

[21] Appl. No.: 619,083

[22] Filed: Jun. 11, 1984

[51] Int. Cl.[4] ..... E02F 3/76

[52] U.S. Cl. ..... 172/813; 285/53; 138/110

[58] Field of Search ..... 138/111, 110, 106, 148; 172/813, 827, 817; 285/46, 53, 148; 137/359

[56] References Cited

U.S. PATENT DOCUMENTS

| | | | |
|---|---|---|---|
| 2,730,823 | 1/1956 | Cassidy | 172/813 |
| 3,082,844 | 3/1963 | MacDonald | 138/111 X |
| 3,315,042 | 4/1967 | Munck | 138/110 X |
| 3,539,021 | 11/1970 | Campen | 172/813 |
| 3,565,181 | 2/1971 | Bahm | 172/817 |
| 3,777,824 | 12/1973 | Anderson | 172/813 |
| 3,920,081 | 11/1975 | Terai | 172/813 |

FOREIGN PATENT DOCUMENTS

| | | | |
|---|---|---|---|
| 480805 | 12/1975 | U.S.S.R. | 172/813 |

*Primary Examiner*—Richard J. Johnson

*Attorney, Agent, or Firm*—Barry E. Deutsch

[57] ABSTRACT

A conduit arrangement for a tilt cylinder of a bulldozer having a track frame and a push arm connected to the track frame for operating the blade of the bulldozer and including a trunnion for pivotally connecting the push arm to the track frame. A pair of spaced fluid passages are provided through the trunnion. A first pair of conduits have one end coupled to the tilt cylinder and the other end connected to the fluid passages. The first pair of conduits pass through an internal bore provided through the push arm. The inboard end of the trunnion extends into the interior of the track frame. The fluid passages extend through the trunnion into the interior of the track frame. A second pair of conduits pass inwardly through the track frame towards the main frame of the bulldozer. One end of each of the second pair of conduits is connected to the fluid passages and the other end extends into the bulldozer main frame. The track frame is spaced from the bulldozer main frame. A flexibly supported, generally hollow coupling spans the space between the main frame and the track frame, and defines a protective housing for the second pair of conduits passing therethrough. A hydraulic control valve is connected to the other end of each of the second pair of conduits for controlling the flow of fluid through the first and second pair of conduits to and from the tilt cylinder.

3 Claims, 5 Drawing Figures

CONDUIT ARRANGEMENT FOR TILT CYLINDER OF A BULLDOZER

BACKGROUND OF THE INVENTION

This invention relates to a bulldozer, and more particularly, to an arrangement of conduits for a tilt cylinder of the bulldozer.

As is well known to those skilled in the art, the blade mounted at the front of an endless track type bulldozer must be angled or tilted with respect to the ground during normal dozing operations. Generally, a hydraulic cylinder is used to tilt the blade. The hydraulic cylinder is most often mounted on the push arm connected to the blade for advancing and retracting the blade with respect to the bulldozer frame.

The hydraulic control valve for regulating the flow of fluid to the tilt cylinder is normally located in the operator's compartment on the dozer frame. Hydraulic conduits connect the tilt cylinder to the hydraulic control valve. Unless protected, the hydraulic conduits can be readily damaged by debris such as rocks and trees encountered by the dozer during its normal operations.

To protect the conduits from damage, the conduits are routed from the tilting cylinder through a passage formed in the push arm and emerge at the rear of the push arm at a trunnion pivotally connecting the push arm to the track frame of the dozer. Heretofore, the hydraulic conduits have either been routed about or through the trunnion. When routed about the trunnion, special covers had been required to minimize the probability of the conduits becoming damaged from debris; however, even when covered, debris has found its way into the portion of the machine through which the conduits are routed, and has damaged the same. Even when routed through the trunnion, damage to the flexible conduits has occurred due to chafing and torsion produced wear occasioned by the relative movement between the push arm and track frame.

In present designs, the hydraulic conduits pass through the track frame and hence into the main frame of the dozer. The conduits are routed through the main frame to the hydraulic control valve. Since, the track frame is spaced from the main frame, the portion of the conduits spanning the space must be protected from damage. Further, since the track frame pivots relative to the main frame during operation of the bulldozer, the protective means, for the portion of the hydraulic conduits spanning the space between the track frame and main frame, should withstand the relative motion without being damaged thereby.

SUMMARY OF THE INVENTION

Accordingly, it is an object of this invention to protect the hydraulic conduits providing fluid from a control valve to a hydraulic cylinder employed to tilt the blade of a bulldozer.

It is a further object to this invention to protect the hydraulic conduits spanning the space between the track frame and main frame of a bulldozer, while compensating for the relative motion between the track frame and main frame.

These and other objects of the present invention are attained in a conduit arrangement for a tilt cylinder of a bulldozer having a track frame and a push arm connected to said track frame for operating the blade of the bulldozer, said arrangement comprising a trunnion for pivotally connecting the push arm to the track frame and including a pair of spaced fluid passages provided therethrough; first conduit means having one end coupled to the tilt cylinder and the other end connected to the fluid passages, the first conduit means passing through an internal bore provided through the push arm; the inboard end of the trunnion extending into the interior of the track frame, with the fluid passages extending through the trunnion into the interior of the track frame; second conduit means passing inwardly through said track frame towards the main frame of the bulldozer and having one end connected to the fluid passages and the other end extending into the bulldozer main frame, said track frame being spaced from the bulldozer main frame; a generally hollow coupling spanning the space between the main frame and the track frame, and defining a protective housing for said second conduit means passing therethrough and a hydraulic control valve connected to the other end of the second conduit means for controlling the flow of fluid through the first and second conduit means to and from the tilt cylinder.

DETAILED DESCRIPTION OF THE PREFERRED EMBODIMENTS

Figure 1:
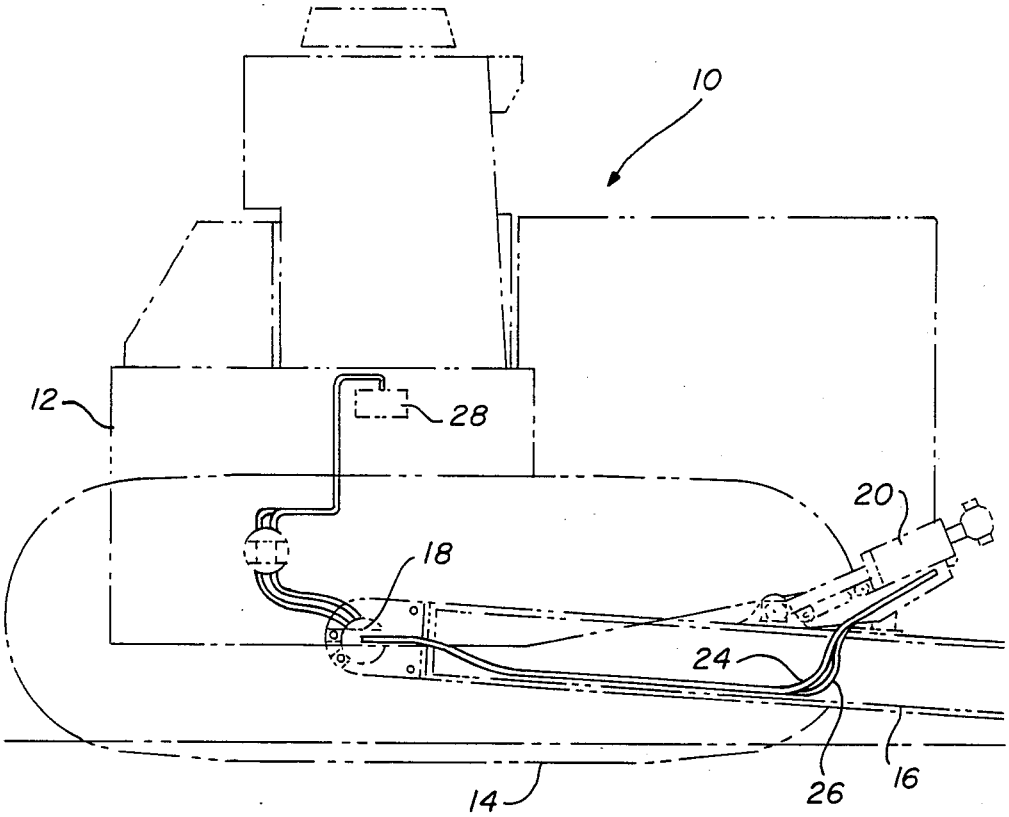
FIG. 1 is a side elevational view of a bulldozer including the hydraulic conduit arrangement of the present invention.

Referring now to the various figures of the drawing, there is disclosed preferred embodiments of the present invention. In referring to the various figures of the drawing, like numerals shall refer to like parts.

Referring particularly to FIG. 1, there is illustrated in phantom a side view of a bulldozer 10 of rather standard construction. Dozer 10 includes a main frame 12, a track frame 14, and a push arm 16 which is pivotally connected to the track frame through a trunnion 18 to be more fully described in detail hereinafter. Push arm 16 is connected to the dozer blade (not shown), which, as is standard within the art, is mounted at the front end of the main frame.

A tilt cylinder 20 is mounted at the front of the dozer and is connected to the blade for tilting the blade relative to the ground. As shown clearly in FIG. 3, push arm 16 is hollow and includes an internal bore 22 through which a pair of conduits 24, 26 are passed. As illustrated in FIG. 1, an end of each conduit 24, 26 is connected to tilt cylinder 20 to deliver fluid thereto for hydraulically moving the dozer blade. Conduits 24, 26 are connected to a hydraulic valve 28 through means to be more fully described hereinafter. Hydraulic control valve 28 regulates the flow of fluid to cylinder 20.

Figure 2:
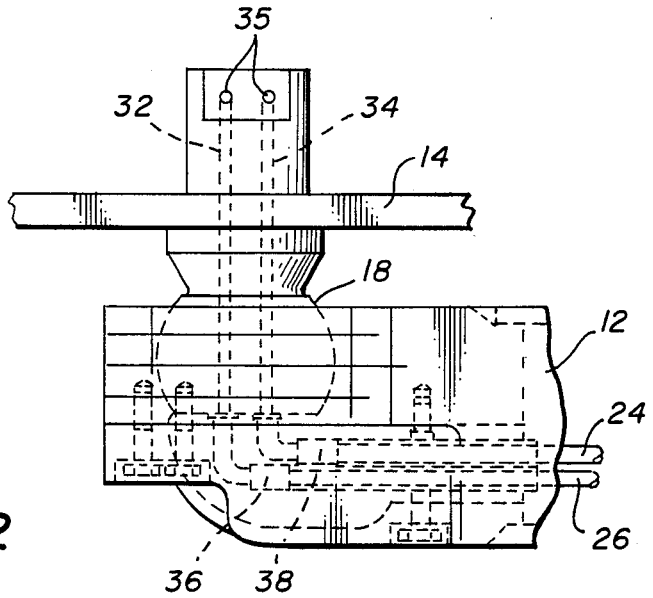
FIG. 2 is an enlarged plan view of a detail illustrated in FIG. 3.
Figure 3:
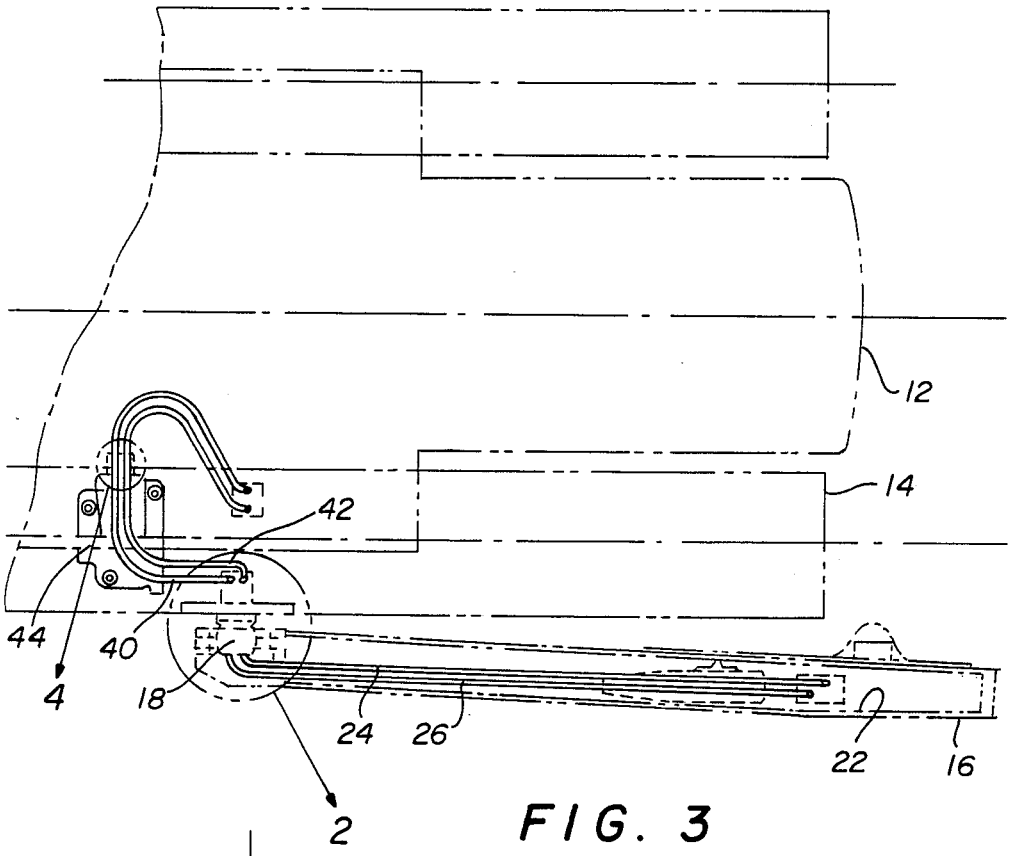
FIG. 3 is a plan view of the conduit arrangement according to the present invention.

As illustrated particularly in FIGS. 2 and 3, trunnion 18 functions as a pivot for pivotally joining push arm 16 to track frame 14. Trunnion 18 has a pair of internal bores 32, 34 machined therethrough for defining a pair of fluid passages. Internal bores 32, 34 are connected to fluid conduits 24, 26 by suitable connecting means 36, 38.

As illustrated in FIGS. 2 and 3, conduits 40, 42 connect with ends 35 of passages 32, 34; ends 35 project into the interior of track frame 14 and include further internally machined passages formed perpendicular to the horizontal axis of trunnion 18. The vertical passages terminate at the horizontal surface of the portion of trunnion 18 projecting into the interior of track frame 14.

Hydraulic conduits 40, 42 connect to these vertical passages through suitable connectors. Conduits 40, 42 are routed through the interior of track frame 14 rearward to the track frame pivot on bulldozer main frame 12. Covers 44 are provided on track frame 14 to facilitate the installation of conduits 40, 42.

Figure 4:
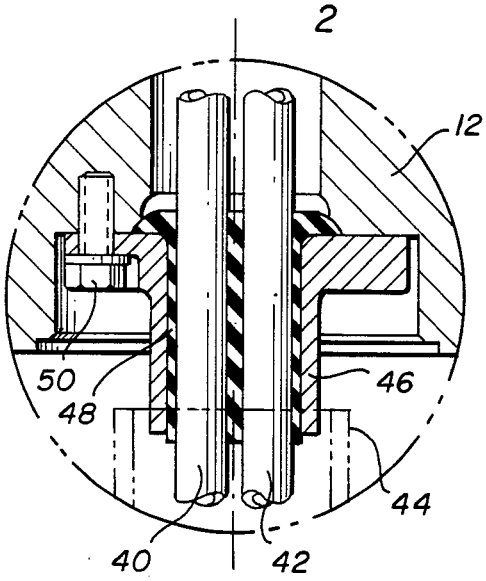
FIG. 4 is a sectional view of a detail illustrated in FIG. 3.

As illustrated in FIGS. 3 and 4, a generally hollow, cylindrically shaped coupling 46 spans the space between the track frame 14 and bulldozer main frame 12. Coupling 46 provides a protective housing for conduits 40, 42, to protect the conduits from external damage as they pass from the interior of track frame 14 to the interior of main frame 12.

As illustrated in FIG. 4, one end of the coupling extends within cover 44 mounted on track frame 14 and the other end of the coupling is connected by suitable means such as cap screw 50 to the tractor main frame. The one end of coupling 46 extending within cover 44 mounted on track frame 14 is permitted to move in the vertical, horizontal and lateral planes relative to the cover to accomodate movement of the track frame relative to the main frame during operation of the bulldozer. In effect, the end of coupling 46 projecting into cover 44 fits loosely therewithin to provide a flexible mount for the coupling.

A sleeve 48, formed from elastomeric or other resilient material, is placed within the inner surface of coupling member 46 and fits about the outer surface of conduits 40, 42. Sleeve 48, in combination with coupling member 46, protects the conduits from damage from external sources that the conduits would otherwise be exposed to in spanning the space between the track and main frames.

Figure 5:
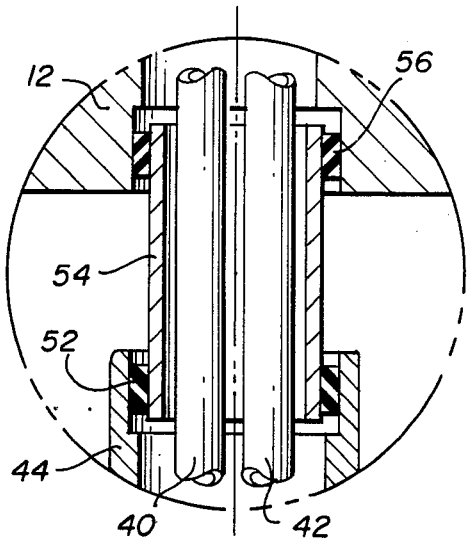
FIG. 5 is a sectional view similar to that illustrated in FIG. 4, showing an alternative embodiment to the arrangement shown in FIG. 4.

Referring now to FIG. 5, there is illustrated an alternative embodiment of the coupling member illustrated in FIG. 4. In the embodiment illustrated in FIG. 5, cylindrical coupling member 54 is supported at both its ends by elastomeric members 52, 56 which function as seals to prevent foreign matter from gaining entrance into either track frame 14, or main frame 12. Resilient members 52, 56 also enable the cylindrical coupling member 54 to move in the vertical, horizontal and lateral planes as the track frame moves relative to the main frame during normal operations of the bulldozer.

Referring to FIGS. 1 and 3, it will be observed that conduits 40 and 42 extend through the coupling member into the interior of main frame 12, and thence pass through an opening formed in the main frame to connect with hydraulic control valve 28.

By utilizing the machined internal bores 32, 34 formed in trunnion 18, in combination with cylindrical coupling members 46 or 54, the hydraulic conduits 24, 26, 40 and 42 are completely protected from external damage as they pass from the tilt cylinder to the hydraulic control valves.

While preferred embodiments of the present invention have been described and illustrated, the invention should not be limited thereto but may be otherwise embodied within the scope of the following claims.

The embodiments of the invention in which an exclusive property or privilege is claimed are defined as follows:

1. A conduit arrangement for a tilt cylinder of a bulldozer having a track frame and a push arm connected to said track frame for operating the blade of the bulldozer, said arrangement comprising:

a trunnion for pivotally connecting the push arm to the track frame and including a pair of spaced bores defining a pair of spaced fluid passages provided therethrough;

first conduit means having one end coupled to said tilt cylinder and the other end connected to said fluid passages, said first conduit means passing through an internal bore provided through said push arm;

the inboard end of said trunnion extending into the interior of said track frame, with said fluid passages extending through said trunnion into the interior of said track frame;

second conduit means passing inwardly through said track frame towards the main frame of said bulldozer and having one end connected to said fluid passages and the other end extending into said bulldozer main frame, said track frame being spaced from said bulldozer main frame;

a generally hollow coupling spanning the space between said main frame and said track frame and defining a protective housing for the second conduit means passing therethrough;

flexible mounting means for connecting the ends of said coupling to said track and main frames to permit relative motion between said two ends in the vertical, horizontal and lateral planes, said flexible mounting means including resilient means circumferentially surrounding the coupling including a first resilient member provided at the coupling track frame end, and a second resilient member provided at the coupling main frame end; and a hydraulic control valve connected to the other end of said second conduit means for controlling the flow of fluid through said first and second conduit means to and from said tilt cylinder.

2. A conduit arrangement for a tilt cylinder of a bulldozer having a track frame and a push arm connected to said track frame for operating the blade of the bulldozer, said arrangement comprising:

a trunnion for pivotally connecting the push arm to the track frame and including a pair of spaced bores defining a pair of spaced fluid passages provided therethrough;

first conduit means having one end coupled to said tilt cylinder and the other end connected to said fluid passages, said first conduit means passing through an internal bore provided through said push arm;

the inboard end of said trunnion extending into the interior of said track frame, with said fluid passages extending through said trunnion into the interior of said track frame;

second conduit means passing inwardlly through said track frame towards the main frame of said bulldozer and having one end connected to said fluid passages and the other end extending into said bulldozer main frame, said track frame being spaced from said bulldozer main frame;

a generally hollow coupling spanning the space between said main frame and said track frame and defining a protective housing for the second conduit means passing therethrough;

flexible mounting means for connecting the ends of said coupling to said track and main frames to permit relative motion between said two ends in the vertical, horizontal and lateral planes, the flexible mounting means including a mounting member connected to a selected one of said track and main frames and including an opening for loosely receiving the coupling associated with said selected one frame, the other end of said coupling being rigidly attached to the other of said frames for movement therewith; and a hydraulic control valve connected to the other end of said second conduit means for controlling the flow of fluid through said first and second conduit means to and from said tilt cylinder.

3. A conduit arrangement in accordance with claim 2 wherein said flexible mounting means comprises a flexible sleeve sandwiched between the inner surface of said hollow coupling and the outer surface of said second conduit means.

* * * * *